United States Patent [19]

Arkans et al.

[11] 4,320,746

[45] Mar. 23, 1982

[54] COMPRESSION DEVICE WITH IMPROVED PRESSURE CONTROL

[75] Inventors: Edward J. Arkans, Schaumburg; Frank K. Villari, Oak Park, both of Ill.

[73] Assignee: The Kendall Company, Boston, Mass.

[21] Appl. No.: 101,358

[22] Filed: Dec. 7, 1979

[51] Int. Cl.[3] ..... A61H 1/00

[52] U.S. Cl. ..... 128/24 R

[58] Field of Search ..... 128/24 R, 24.2, 38–40, 128/60, 64, 165, 298, 299, 297, DIG. 20, 133, 134, 87 R, 89 R

[56] References Cited

U.S. PATENT DOCUMENTS

| | | | |
|---|---|---|---|
| 3,862,629 | 1/1975 | Rotta | 128/24 R |
| 3,866,604 | 2/1975 | Curless et al. | 128/64 |
| 4,013,069 | 3/1977 | Hasty | 128/24 R |
| 4,029,087 | 6/1977 | Dye et al. | 128/24 R |
| 4,030,488 | 6/1977 | Hasty | 128/24 R |
| 4,091,804 | 5/1978 | Hasty | 128/24 R |
| 4,156,425 | 5/1979 | Arkans | 128/24 R |

FOREIGN PATENT DOCUMENTS

| | | | |
|---|---|---|---|
| 594576 | 3/1934 | Fed. Rep. of Germany | 128/60 |
| 455997 | 11/1936 | United Kingdom | 128/24 R |

*Primary Examiner*—John D. Yasko

*Attorney, Agent, or Firm*—Powell L. Sprunger

[57] ABSTRACT

A device for applying compressive pressures against a patient's limb from a source of pressurized fluid. The device has an elongated pressure sleeve for enclosing a length of the patient's limb, with the sleeve having a plurality of laterally extending separate fluid pressure chambers progressively arranged longitudinally along the sleeve from a lower portion of the limb to an upper portion of the limb proximal the patient's heart relative to the lower portion. The device has a plurality of conduits and connecting devices for connecting the conduits to a plurality of the chambers. The device also varies the effective lumen size associated with a plurality of the connecting members and conduits to vary the pressure rise times in the chambers.

11 Claims, 14 Drawing Figures

FIG. 1
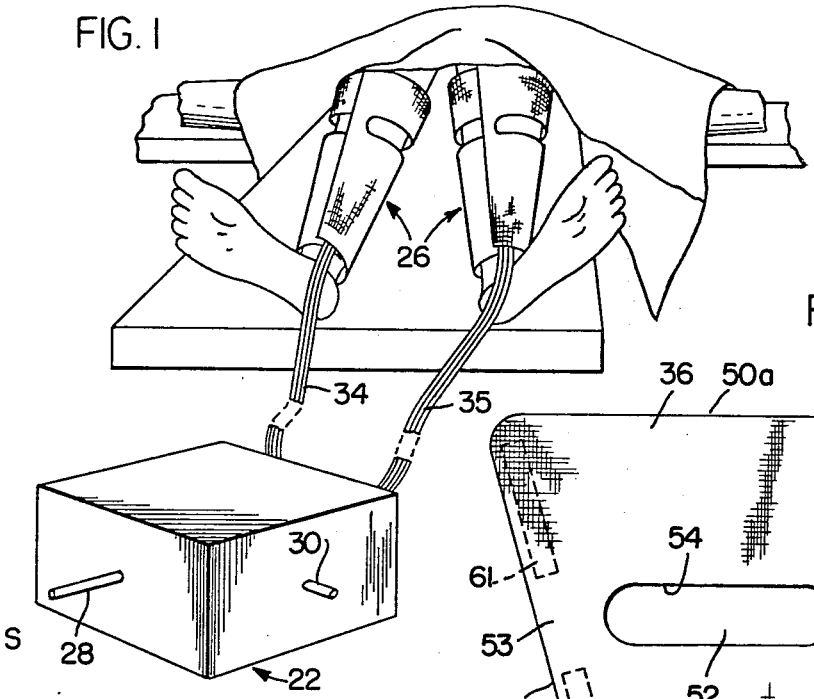
FIG. 2
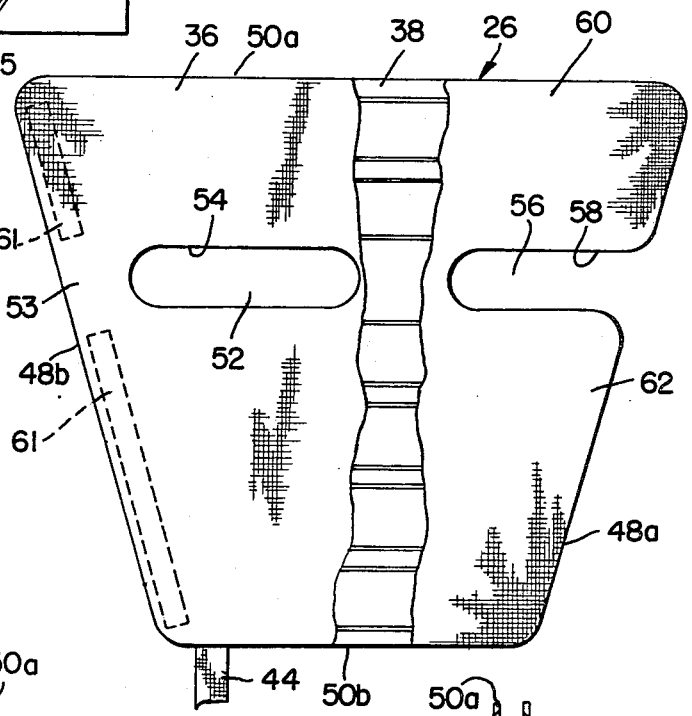
FIG. 3
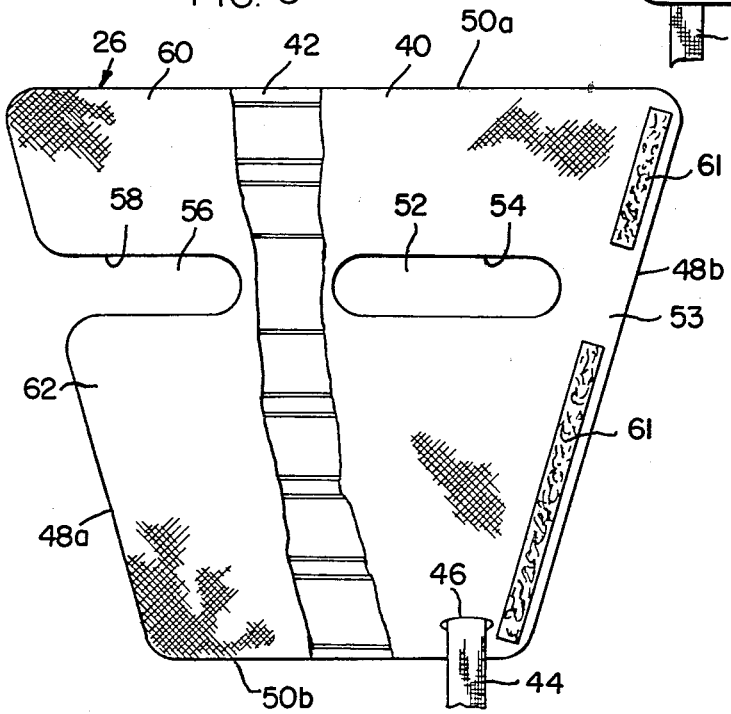
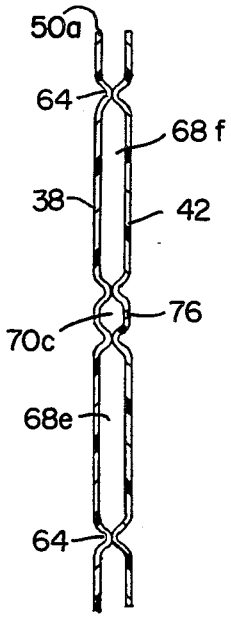
FIG. 8

FIG. 6
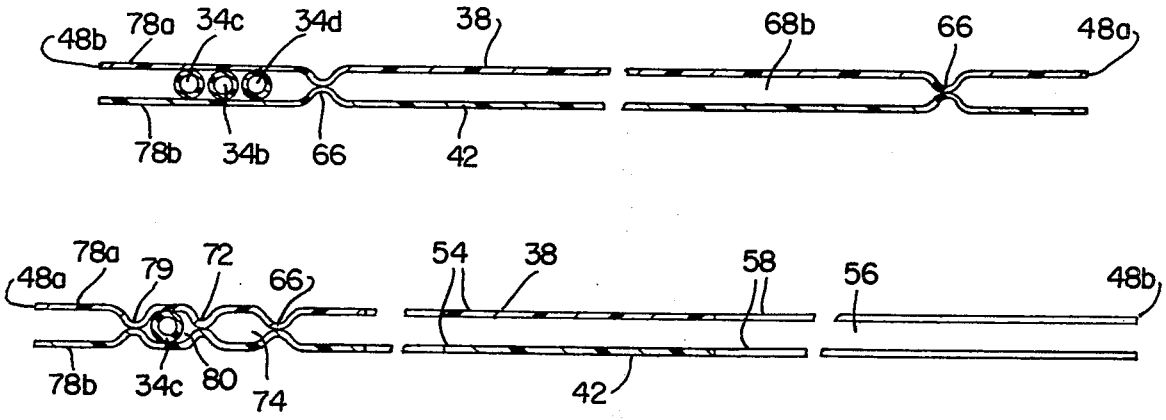
FIG. 7
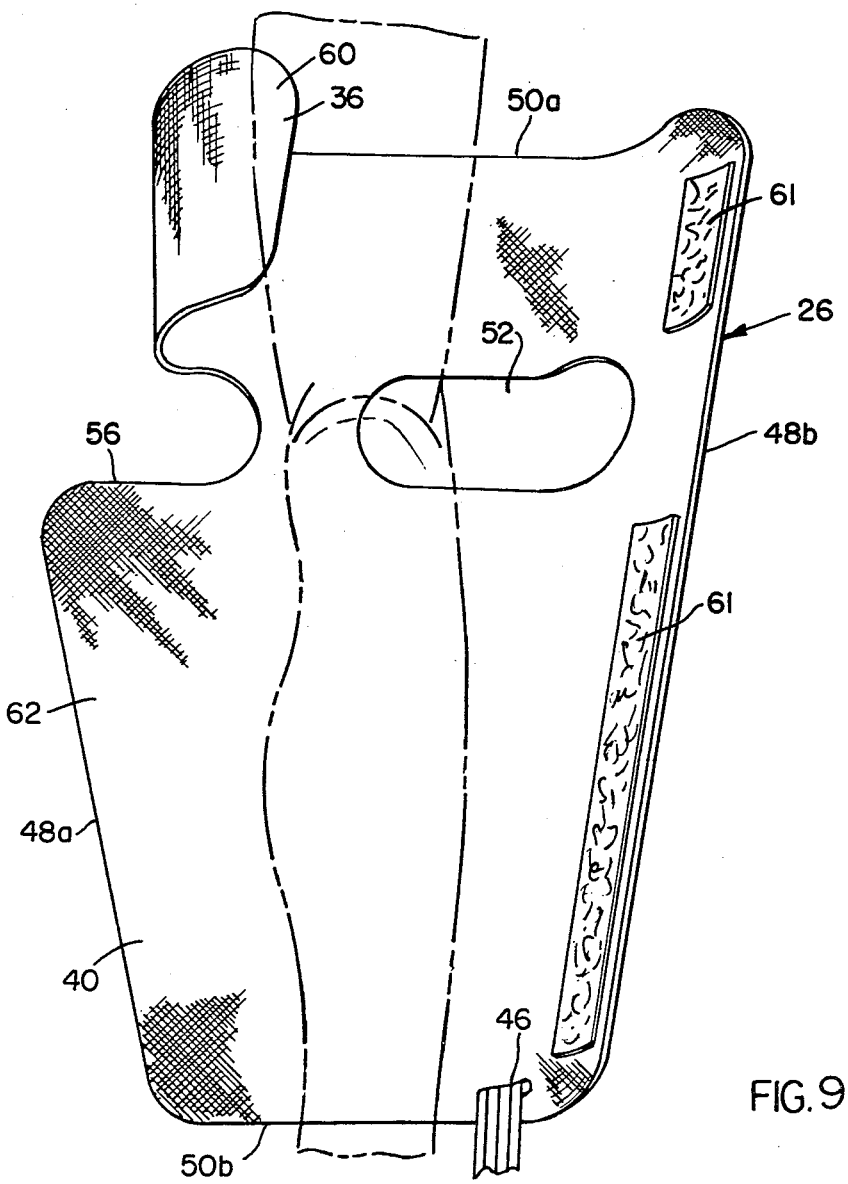
FIG. 9

FIG. 10
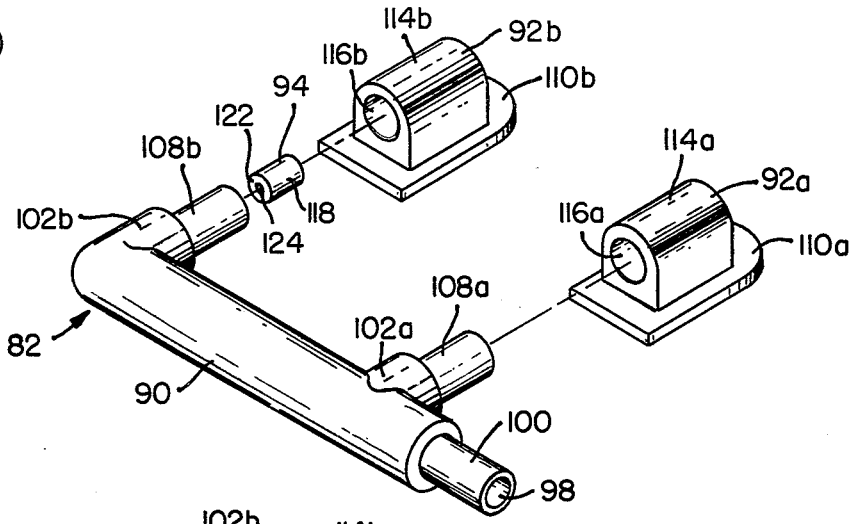
FIG. 11
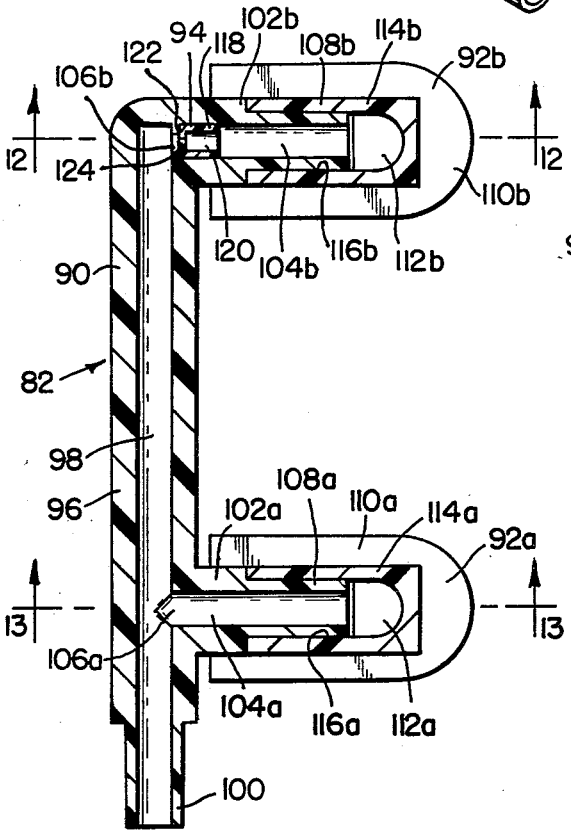
FIG. 12
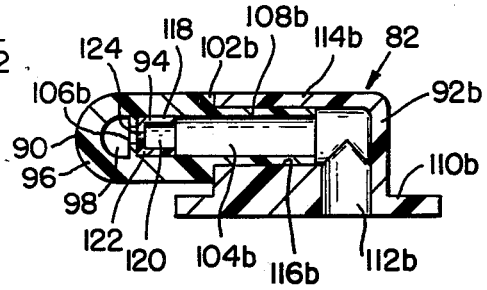
FIG. 13
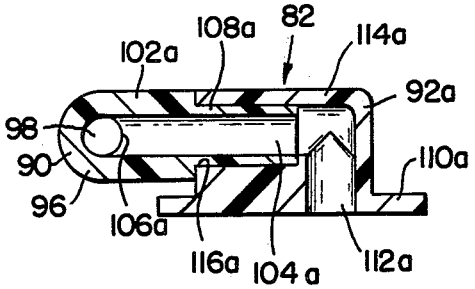
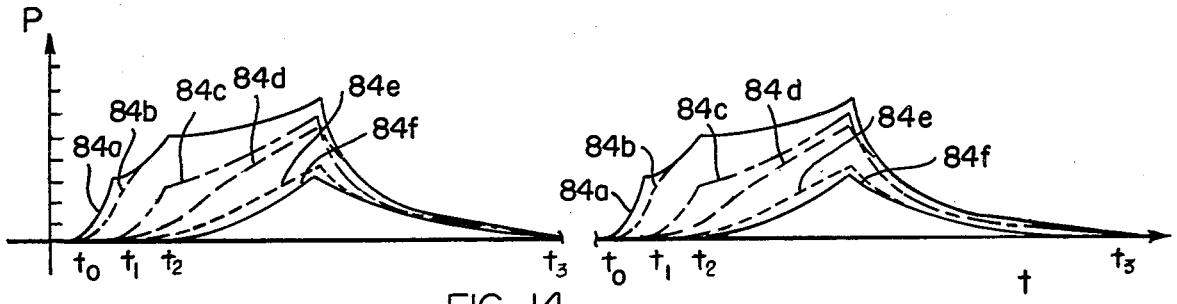
FIG. 14

COMPRESSION DEVICE WITH IMPROVED PRESSURE CONTROL

BACKGROUND OF THE INVENTION

The present invention relates to therapeutic and prophylactic devices, and more particularly to devices for applying compressive pressures against a patient's limb.

It is known that the velocity of blood flow in a patient's extremities, particularly the legs, markedly decreases during confinement of the patient. Such pooling or stasis of blood is particularly pronounced during surgery, immediately after surgery, and when the patient has been confined to bed for extended periods of time. It is also known that stasis of blood is a significant cause leading to the formation of thrombi in the patient's extremities, which may have a severe deleterious effect on the patient, including death. Additionally, in certain patients it is desirable to move fluid out of interstitial spaces in extremity tissues, in order to reduce swelling associated with edema in the extremities.

Devices have been disclosed in U.S. Pat. Nos. 4,013,069 and 4,030,488, incorporated herein by reference, which develop and apply the desired compressive pressures against the patient's limbs. Such devices comprise a pair of sleeves which envelop the patient's limbs, and a controller for supplying fluid pressure to the sleeves. It is disclosed that the pressure rise times in the chambers may be modified through use of manifolds which has required precision in manufacture, and has proved both unduly expensive and inconvenient.

SUMMARY OF THE INVENTION

The principal feature of the present invention is the provision of an improved device for applying compressive pressures from a source of pressurized fluid against a patient's limb.

The device comprises an elongated pressure sleeve for enclosing a length of the patient's limb, with the sleeve having a plurality of laterally extending separate fluid pressure chambers progressively arranged longitudinally along the sleeve from a lower portion of the limb to an upper portion of the limb proximal the patient's heart relative to the lower portion. The device has a plurality of conduits communicating with the pressure source, and a plurality of connecting devices connecting the conduits to the chambers of the sleeve. The connecting devices have restriction members with orifices of varying sizes.

A feature of the present invention is that the pressure rise times in the chambers may be controlled through use of the restriction members in the connecting devices.

Another feature of the invention is that the restriction members may be inserted into the connecting devices in order to define the desired pressure rise times in the chambers.

Thus, another feature of the invention is that the pressure rise times may be controlled through use of the restriction members in a simplified manner.

Yet another feature of the invention is that the restriction members may be readily changed in the connecting devices to modify the pressure rise times in the chambers, as desired.

Still another feature of the invention is that the connecting devices and restriction members utilized to control the pressure rise times may be manufactured at a reduced cost and may be assembled in a simplified manner.

Further features will become more fully apparent in the following description of the embodiments of this invention and from the appended claims.

DESCRIPTION OF THE DRAWINGS

In the drawings:

FIG. 1 is a fragmentary perspective view of a compressive pressure device of the present invention;

FIG. 2 is a front plan view, partly broken away, of a compression sleeve for the device of FIG. 1;

FIG. 3 is a back plan view, partly broken away, of the sleeve of FIG. 2;

FIG. 6 is a fragmentary sectional view taken substantially as indicated along the line 6—6 of FIG. 4;

FIG. 7 is a fragmentary sectional view taken substantially as indicated along the line 7—7 of FIG. 4;

FIG. 8 is a fragmentary sectional view taken substantially as indicated along the line 8—8 of FIG. 4;

FIG. 9 is a perspective view illustrating the sleeve during placement on a patient's leg;

FIG. 10 is an exploded perspective view of connecting devices for attaching conduits to chambers of the sleeve;

FIG. 11 is a sectional view of the assembled connecting devices of FIG. 10;

FIG. 12 is a sectional view taken substantially as indicated along the line 12—12 of FIG. 11;

FIG. 13 is a fragmentary sectional view taken substantially as indicated along the line 13—13 of FIG. 11; and FIG. 14 is a graph illustrating a typical pressure profile developed in the sleeve chambers during use of the device.

DESCRIPTION OF THE PREFERRED EMBODIMENTS

Figure 4:
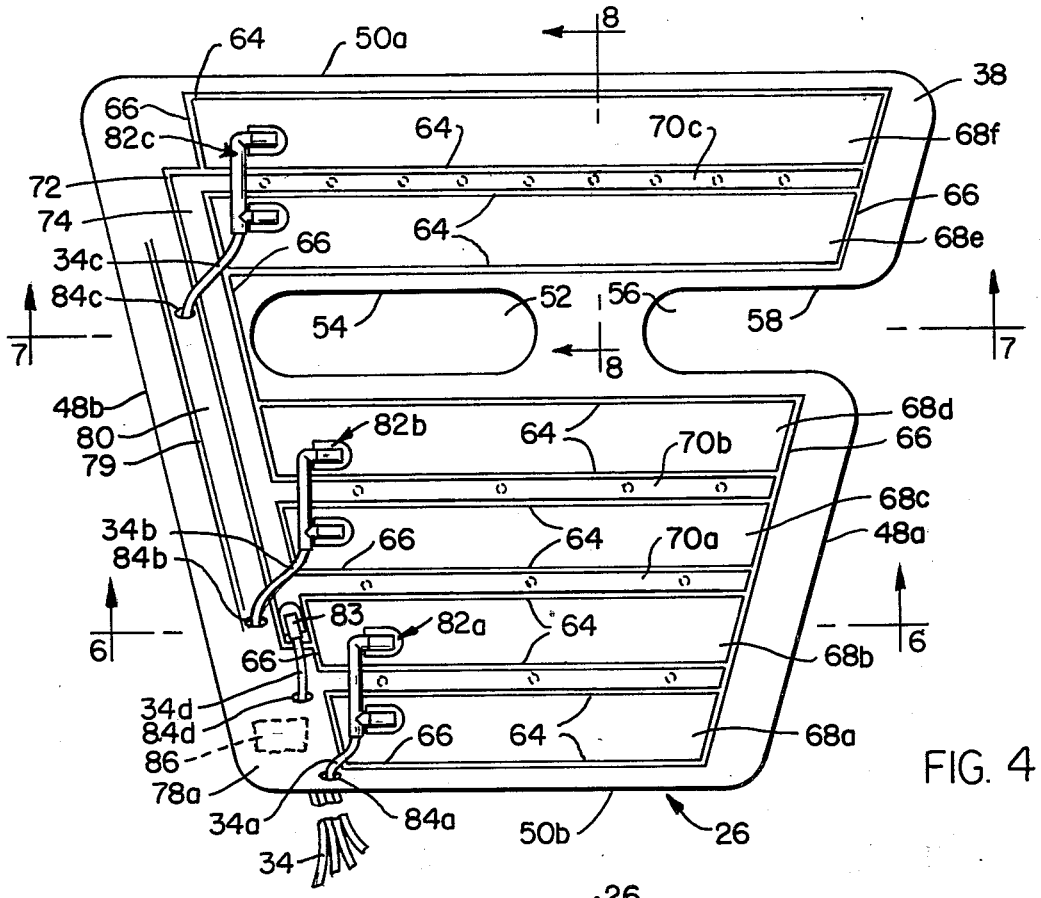
FIG. 4 is a front plan view of fluid impervious sheets defining chambers in the sleeve of FIG. 2.

Referring now to FIG. 1, there is shown an intermittent compression device generally designated 20 having a controller 22, and a pair of elongated compression sleeves 26 for enclosing a length of the patient's extremities, such as the legs as shown. The controller 22 is connected through a tube 28 to a source S of pressurized gas, and to an exhaust tube 30. Also, the controller 22 is connected to the separate sleeves 26 through separate sets of conduits 34 and 35. The controller may be of any suitable type, such as the controllers described in U.S. Pat. Nos. 4,013,069 and 4,030,488.

With reference to FIGS. 2 and 3, the sleeve 26 has an outer cover sheet 36 covering the entire outer surface of an outer fluid impervious barrier sheet 38. Also, the sleeve 26 has an inner cover sheet 40 covering an inner surface of an inner fluid impervious barrier sheet 42. The outer cover sheet 36 may comprise a relatively inelastic fabric with a brushed matte or napped finish of nylon or polyester, such as a fabric sold under the trademark Flannel/Flannel II, No. 11630, by Guilford Mills, Greensboro, N.C., which provides an attractive outer surface for the sleeve, and also defines brushed or napped fibers across the entire outer surface of the sleeve for a purpose which will be described below. In suitable form, the fabric of the sheet 36 may be warp knit from polyester yarns on a tricot machine, after which the fabric is dyed to a suitable color, and the fabric is brushed or napped on a suitable machine to raise loops from the fabric. The inner cover sheet 40 may comprise a suitable nonwoven material which provides a comfortable inner surface of the sleeve for the patient. The barrier sheets may be formed from a suitable flexible plastic material, such as polyvinylchloride. If desired, a segment of the brushed nylon fabric may be formed into a tube 44 to cover the conduits which extend from the sleeve to the controller. As shown, the conduits and covering tube 44 may extend through an opening 46 in the inner cover sheet 40.

The sleeve 26 may have a pair of side edges 48*a* and 48*b*, and a pair of end edges 50*a* and 50*b* connecting the side edges 48*a* and *b*, with the side edges 48*a* and *b* being tapered toward a lower end of the sleeve. The sleeve 26 may also have an elongated opening 52 extending through a knee region 53 of the sleeve, and defined by peripheral edges 54 extending around the opening 52. In addition, the sleeve 26 has an elongated opening or cut-out 56 in the knee region 53 extending from the side edge 48*a* toward a lateral central portion of the sleeve, with the opening 56 being defined by peripheral edges 58 extending from the side edge 48*a* around the opening 56. As shown, the inner end of the opening 56 is spaced from the opening 54, and the opening 56 defines an upper flap 60 and a lower flap 62 of the sleeve which are separated by the opening 56. Further, the sleeve 26 may have a pair of lower fastening strips 61, such as a hook material sold under the trademark Velcro, secured to the inner cover sheet 40 along the side edge 48*b*.

Figure 5:
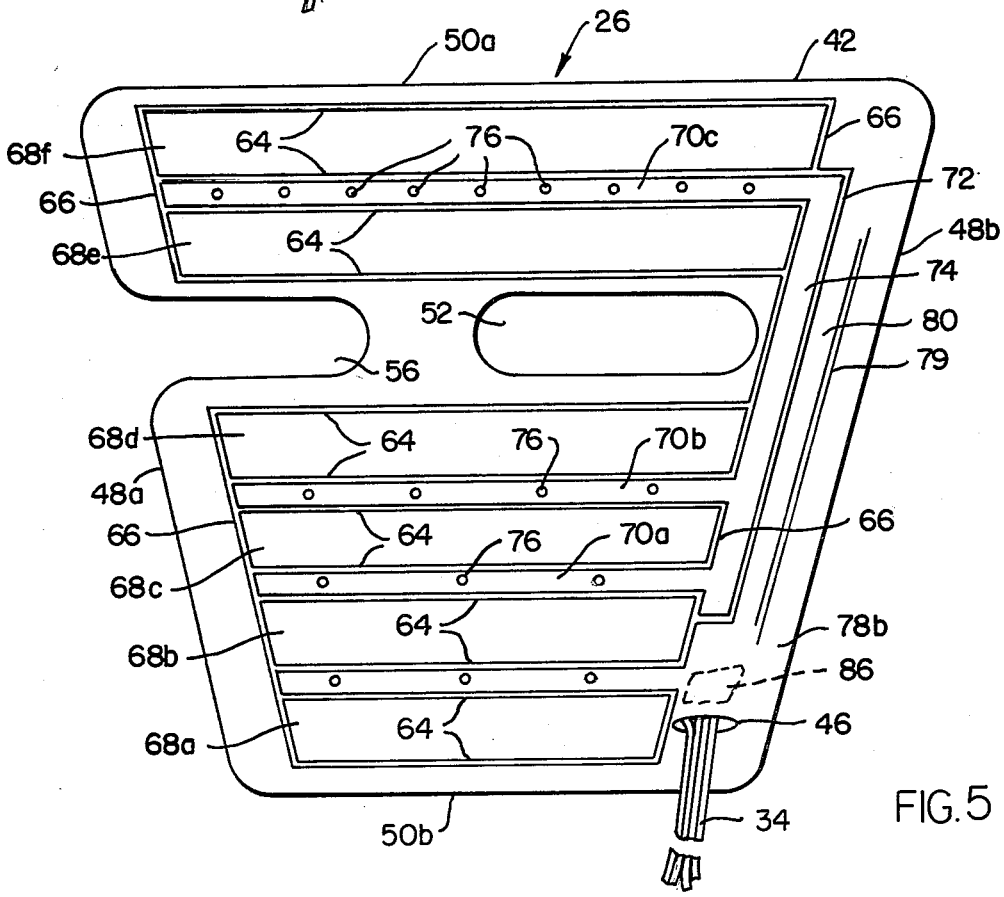
FIG. 5 is a back plan view of the fluid impervious sheets of FIG. 4.

With reference to FIGS. 4–8, the inner and outer fluid impervious barrier sheets 38 and 42 have a plurality of laterally extending lines 64, such as lines of sealing, connecting the barrier sheets 38 and 42 together, and longitudinally extending lines 66, such as lines of sealing, connecting the sheets 38 and 42 together and connecting ends of the lateral lines 64, as shown. The connecting lines 64 and 66 define a plurality of longitudinally disposed chambers 68*a*, 68*b*, 68*c*, 68*d*, 68*e*, and 68*f*, which for convenience will be termed contiguous. As shown, the chambers 68 extend laterally in the sheets 38 and 42, and are disposed in the longitudinal arrangement between the end edges 50*a* and 50*b*. When the sleeve is placed on the patient's leg, the lowermost chamber 68*a* is located on a lower part of the leg adjacent the patient's ankle, while the uppermost chamber 68*f* is located on an upper part of the leg adjacent the midthigh.

As shown, the longitudinal line 66 nearest the side edge 48*b* is separated intermediate the chambers 68*b* and *c*, 68*c* and *d*, and the chambers 68*e* and *f*. The lateral lines 64 define ventilation channels 70*a*, 70*b*, and 70*c* extending laterally in the sleeve from the longitudinal line 66 adjacent the side edge 48*a* toward the longitudinal lines 66 adjacent the side edge 48*b*, with the ventilation channels 70 being positioned at spaced locations longitudinally along the sleeve intermediate different pairs of adjoining chambers. Thus, the ventilation channel 70*a* is located intermediate the chambers 68*b* and 68*c*, the ventilation channel 70*b* is located intermediate the chambers 68*c* and 68*d*, and the ventilation channel 70*c* is located intermediate the chambers 68*e* and 68*f*. Moreover, the ventilation channels 70 have a width substantially less than the width of the chambers 68 such that the channels 70 do not detract from the size and volume required for the compression chambers 68. The inner and outer barrier sheets 38 and 42 also have a longitudinally extending line 72 which defines a connecting channel 74 intermediate the line 72 and the adjacent longitudinal line 66. As shown, the connecting channel 74 extends along the sides of the chambers 68*c*, 68*d*, and 68*e*, and communicates with the ventilation channels 70*a*, *b*, and *c*, such that the channel 74 connects the spaced ventilation channels 70. Further, the inner barrier sheet 42 has a plurality of openings or apertures 76 which communicate with the channels 70. Thus, when the sleeve 26 is placed on the patient's leg, the openings 76 face toward the leg.

With reference to FIGS. 4–7, the longitudinal lines 66 and 72 adjacent the side edge 48*b* define a pair of flaps 78*a* and 78*b* of the barrier sheets 38 and 42 which extend between the respective lines and the side edge 48*b*. As shown, the sheets 38 and 42 have a longitudinally extending line 79 which defines a directing channel 80 intermediate the lines 79 and 72, with the opposed longitudinal ends of the channel 80 being open. The sleeve 26 has a first connecting device 82*a* which is commonly connected in fluid communication to the two lowermost chambers 68*a* and 68*b*, and which is connected to a conduit 34*a* in the illustrated conduit set 34. As shown, the conduit 34*e* passes through an opening 84*a* in the upper barrier sheet flap 78*a* which retains the conduit 34*a* at the desired position in the sleeve 26. The sleeve 26 also has a second connecting device 82*b* which is commonly connected in fluid communication to the second pair of adjoining chambers 68*c* and 68*d*, and which is connected to a second conduit 34*b* in the conduit set 34. The conduit 34*b* passes through an opening 84*b* in the upper flap 78*a* which retains the conduit 34*b* at the desired position. The sleeve 26 has a third connecting device 82*c* which is commonly connected in fluid communication to the uppermost chambers 68*e* and 68*f*, and which is connected to a third conduit 34*c* in the conduit set 34. As shown, the conduit 34*c* passes through an opening 84*c* in the upper flap 78*a*, with the conduit 34*c* extending through the directing channel 80 in order to retain the third conduit 34*c* at the desired position in the sleeve. The sleeve 26 also has a connector 83 which is connected in fluid communication to the connecting channel 74 in order to permit passage of air to the ventilation channels 70. As shown, the connector 83 is connected to a fourth conduit 34*d* in the conduit set 34, with the conduit 34*d* passing through an opening 84*d* in the upper barrier flap 78*a*. Thus, the conduits 34*a*, 34*b*, and 34*c* are separately connected to pairs of adjoining chambers, while the conduit 34*d* is connected to the connecting channel 74. Of course, the other sleeve associated with the conduits 35 may be constructed in a similar manner. It will be apparent that the barrier flaps 78*a* and 78*b*, the directing channel 80, and the openings 84 cooperate to retain the conduits at the desired position within the sleeve. Further, the sleeve 26 has suitable securing means 86, such as regions of heat sealing or adhesive, bonding the flaps 78*a* and 78*b* to opposed sides of the conduits 34 adjacent the opening 46. Thus, in the event that forces are applied to the conduits 34 exterior the sleeve 26, the forces are transmitted to the flaps 78*a* and *b* rather than the connectors 82*a*, *b*, and *c*, in order to relieve possible strain from the connectors and prevent severance of the connectors from the sleeve.

In use, the sleeve 26 may be placed below the patient's leg preparatory to securement about the limb, as illustrated in FIG. 9. Next, the upper flap 60 and lower flap 62 may be independently passed around the patient's leg at locations above and below the knee, respectively. Thus, the opening 56 separates the flap portions of the sleeve in the region of the knee to permit independent wrapping of the upper and lower portions of the sleeve about the leg and simplify placement of the sleeve, as well as provide an improved fit. After both the upper and lower flaps 60 and 62 have been suitably wrapped about the patient's limb, the remaining part of the sleeve adjacent the side edge 48*b* may be wrapped over the flaps 60 and 62, and the fastening strips 61 may be pressed against the outer cover sheet 36. Thus, the hook fastening strips 61 engage with the brushed fibers of the outer cover sheet 36, such that the strips 61 and sheet 36 interengage and retain the sleeve in the wrapped configuration. Since the sheet 36 extends entirely across the outer surface of the sleeve 26, the sleeve may be readily adjusted as necessary for the desired fit according to the size of the patient's leg. Thus, the sleeve 26 may be placed in a simplified manner while accomplishing an improved fit on patients having varying leg sizes. In addition, the openings 52 and 56 greatly reduce the amount of material and bulk for the sleeve in the region of the patient's knee. Accordingly, the sleeve provides flexibility in the knee region in order to prevent binding and permit flexation of the knee during the extended periods of time while the sleeve is secured about the leg.

After placement of the sleeves on the patient's limbs, the controller 22 may be initiated in order to supply air to the sleeves 26. The controller 22 intermittently inflates the chambers 68 during periodic compression cycles, and intermittently deflates the chambers 68 through the exhaust tube 30 during periodic decompression cycles intermediate the compression cycles. The inelastic cover sheet 36 of the placed sleeve restricts the size of the inflated chambers, and greatly enhances the compressive action of the chambers to permit lower fluid volumes during the compression cycles. Further, the controller 22 supplies air through the conduits to the connecting channels 74 in the two sleeves. The air then passes from the common connecting channels 74 to the spaced ventilation channels 70 and through the openings 76 onto the patient's legs. In this manner, the device 20 ventilates a substantial portion of the patient's legs to prevent heat buildup and provide comfort for the patient during extended periods of time while the sleeves are retained in a wrapped condition about the patient's limbs. In a preferred form, the controller 22 supplies air to the ventilation channels 70 during the periodic decompression cycles. Also, the controller 22 may have suitable means, such as a switch, to selectively permit passage of air to the ventilation channels 70 or prevent passage of air to the ventilation channels 70, as desired. In addition, the switch may be utilized to control the quantity of air which ventilates the patient's limbs for maximum patient comfort.

The connecting devices 82 are illustrated in FIGS. 10–13, and comprise a connecting member 90, a pair of adapters 92*a* and 92*b* associated with the connecting member 90, and a restriction member 94. The connecting member 90 has an elongated tubular member 96 defining a lumen 98, and an annular end section 100 of smaller outside diameter for placement in the downstream lumen end of the associated conduit. The connecting member 90 also has a pair of spaced lower and upper connecting portions 102*a* and 102*b*, respectively, extending outwardly from the tubular member 96, with the connecting portions 102*a* and *b* defining associated ports 104*a* and 104*b* of uniform diameter communicating with the lumen 98 of the tubular member 36 through associated apertures 106*a* and 106*b*. The connecting portions 102*a* and *b* have annular end sections 108*a* and 108*b* of reduced external diameter for a purpose which will be described below.

The adapters 92*a* and *b* have generally planar lower flanges 110*a* and 110*b*, respectively, for securement to the sleeve with respective apertures 112*a* and 112*b* of the adapters 92*a* and *b* in communication with adjoining chambers of the sleeve. The adapters 92*a* and *b* also have housings 114*a* and 114*b*, respectively, defining outer openings 116*a* and 116*b* having an inner diameter approximately equal to the outside diameter of the connecting member end sections 108*a* and *b*, such that the connecting member end sections 108*a* and *b* may be received in the associated openings 116*a* and *b* of the adapters 92*a* and *b*. Thus, each of the connecting devices 82 establishes communication between a conduit and adjoining sleeve chambers through the associated connecting member 90 and spaced adapters 92*a* and *b* communicating with the adjoining chambers.

The restriction member 94 has a cylindrical section 118 having an outside diameter approximately equal to the inside diameter of the connecting portion ports 104*a* and *b*, with the cylindrical section 118 defining a relatively short lumen 120. The restriction member 94 also has an end wall 122 defining an orifice 124 extending through the wall 122 and having a diameter substantially less than the diameter of the ports 104*a* and *b* in the connecting portions 102*a* and *b* and the sizes of the apertures 106*a* and *b* of the connecting member 90. The restriction members 94 may be inserted into the ports 104*a* and/or 104*b* of the connecting portions 102*a* and *b* with the end walls 122 preferably facing the connecting member apertures 106*a* and *b*, and the orifice size of the restriction members 94 may be selected to limit passage of fluid from the connecting member lumen 98 to the adapters 92*a* and/or 92*b* and the associated adjoining chambers. Accordingly, control of fluid passage may be accomplished in the simplified manner of selecting and inserting a restriction member 94 with desired orifice size into the desired connecting portions 102*a* and 102*b*. In this manner, the rate of pressure increases may be readily controlled to produce the desired pressure rise times in the sleeve chambers during inflation thereof.

In a suitable form, the restriction members 94 may be inserted only in the upper connecting portion 102*b* of each of the connecting devices 82*a*, 82*b*, and 82*c*, while leaving the ports 104*a* of the lower connecting portions 102*a* in the connecting devices 82*a*, 82*b*, and 82*c* free of obstruction, although it will be understood that suitable restriction members may be inserted into the lower connecting portions 102*a*, if desired. A suitable configuration for the sizes of the connecting member ports and restriction member orifices will be set forth as follows. The ports 104*a* and *b* of the connecting portions 102*a* and *b* in each of the connecting members 90 may have an inside diameter of approximately 0.141 inches. The restriction member 94 inserted into the upper connecting portion 102*b* of the connecting device 92*a* may have a diameter of approximately 0.046 inches, the restriction member 94 inserted into the upper connecting portion 102*b* of the connecting device 82*b* may have an inside diameter of approximately 0.037 inches, and the restriction member 94 inserted into the connecting portion 102*b* of the connecting device 82*c* may have an inside diameter of approximately 0.046 inches.

A chart of a typical pressure profile developed by the device of the present invention is illustrated in FIG. 14 where the pressure P is plotted against the time t, with the sleeve chambers being intermittently inflated during periodic inflation cycles between the times $t_0$ to $t_3$, and being intermittently deflated during periodic decompression cycles between the times $t_3$ to $t_0$, i.e., between the inflation cycles. In a preferred form, a plurality of timed fluid pressure pulses are applied at time $t_0$ to chambers 84*a* and 84*b*, at time $t_1$ to chambers 84*c* and 84*d*, and at time $t_2$ to chambers 84*e* and 84*f*. During inflation of the lower first set of adjoining chambers 84*a* and *b*, the associated restriction member 94 limits passage of fluid into the upper chamber 84*b* of the set, such that the rate of pressure increase of the lower chamber 84*a* is greater than that in the upper chamber 84*b*. During subsequent inflation of the second set of adjoining chambers 84*c* and 84*d*, the associated restriction member 94 limits passage of fluid into the upper chamber 84*d* of the set, such that the rate of pressure increase of the lower chamber 84*c* is greater than that of the upper chamber 84*d*. Similarly, during subsequent inflation of the third set of adjoining chambers 84*e* and 84*f*, the associated restriction member limits passage of fluid into the upper chamber 84*f* of the set, resulting in a rate of pressure increase of the lower chamber 84*e* greater than the rate of pressure increase of the upper chamber 84*f*. Accordingly, through use of the timed pulses at times $t_0$, $t_1$, and $t_2$, in combination with the restriction members 94 to control the rate pressure increases in the chamber sets, a compressive pressure gradient is developed which decreases from the lowermost chamber 84*a* to the uppermost chamber 84*f* of the sleeve.

Thus, in accordance with the present invention, a compressive pressure gradient may be established in the pressure profile exerted by the chambers against the patient's limb through use of the restriction members in the connecting devices. The connecting devices may be manufactured in a simplified manner at a reduced cost, and the restriction members may be readily inserted into the associated connecting members, as desired. Further, the orifice sizes of the restriction members may be suitably selected to define the desired pressure profile, and, of course, the restriction members may be readily changed with orifices of different sizes to modify the pressure profile, if desired.

The foregoing detailed description is given for clearness of understanding only, and no unnecessary limitations should be understood therefrom, as modifications will be obvious to those skilled in the art.

We claim:

1. A device for applying compressive pressures against a patient's limb from a source of pressurized fluid, comprising:

an elongated pressure sleeve for enclosing a length of the patient's limb, said sleeve having a plurality of laterally extending separate fluid pressure chambers progressively arranged longitudinally along the sleeve from a lower portion of the limb to an upper portion of the limb proximal to patient's heart relative to said lower portion;

conduit means for establishing communication between a fluid source and the sleeve chambers;

means for varying the effective lumen size of the conduit means associated with a plurality of chambers at a location downstream relative to the source to vary the pressure rise times in said chambers; and means for intermittently inflating and deflating said pressure chambers, said conduit means comprising a plurality of conduits communicating with a source, and means for connecting downstream end portions of the conduits to the chambers to establish communication between the conduits and chambers, said varying means being located in said connecting means, said connecting means comprising a plurality of connecting members connected to the downstream end portions of said conduits, and a plurality of adapters connected to the sleeve in communication with the sleeve chambers, said connecting members being detachably connected to said adapters, port means establishing communication between the conduits and the sleeve chambers, said varying means comprising means for defining different effective diameters of the port means associated with a plurality of the chambers, said connecting members having ports of uniform diameter, and in which the port defining means comprises removable, replaceable restriction members removably received in a plurality of the ports, with said restriction members having means defining orifices therein, each with a diameter smaller than the diameter of said connecting member ports, at least some of said restriction members having orifices of differing diameters to develop a compressive pressure gradient against a patient's limb by the sleeve which progressively decreases from a lower to an upper limb portion, said restriction members being removable and replaceable so that the profile of said compressive pressure gradient may be changed.

2. The device of claim 1 wherein said restriction members are received in less than the total number of the connecting member port means.

3. The device of claim 1 wherein said connecting members connect each of said conduits to a plurality of said adapters to establish communication between said conduits and a set of associated chambers.

4. The device of claim 3 wherein each of said connecting members define at least two ports of uniform diameter communicating with an associated adapter, and in which the port defining means comprises restriction members received in a plurality of ports, with said restriction members defining orifices with a diameter smaller than the diameter of the associated connecting member ports.

5. The device of claim 4 wherein at least some of said restriction members have orifices of differing diameters.

6. The device of claim 4 wherein said connecting members have a pair of ports connecting each conduit to a pair of adapters communicating with a set of adjoining chambers.

7. The device of claim 4 wherein said connecting members comprise an elongated tubular member having a pair of spaced outwardly directed connecting portions having ports communicating through associated apertures with a lumen of the tubular member.

8. The device of claim 7 wherein said adapters have associated outer openings, and in which the connecting portions have outer annular sections received in the openings of said adapters.

9. The device of claim 7 wherein said restriction members comprise a generally cylindrical section having an outer diameter approximately equal to the inner diameter of the connecting member ports, and an end wall defining an orifice.

10. A sleeve for applying compressive pressures against a patient's limb, comprising:

an elongated pressure sleeve for enclosing a length of a patient's limb, said sleeve having a plurality of laterally extending separate fluid pressure chambers progressively arranged longitudinally along the sleeve from a lower portion of a limb to an upper portion of a limb proximal a patient's heart relative to a limb lower portion;

a plurality of conduits having upstream ends and downstream ends;

means for connecting the conduits to a plurality of said chambers comprising a plurality of connectors detachably connected to the sleeve; and means for varying the effective lumen size of the connectors comprising restricted orifice inserts removably, replaceably received within a plurality of the connectors whereby said inserts may be removed and replaced by other inserts having restricted orifices of different diameters thereby to vary the profile of application of compressive pressures against a patient's limb.

11. A sleeve for applying compressive pressures against a patient's limb, comprising:

an elongated pressure sleeve for enclosing a length of a patient's limb, said sleeve having a plurality of laterally extending separate fluid pressure chambers progressively arranged longitudinally along the sleeve from a lower portion of a limb to an upper portion of a limb proximal a patient's heart relative to a limb lower portion;

a plurality of adapters connected to the sleeve and having outer openings communicating with an associated sleeve chamber;

a plurality of connecting members each having an elongated tubular member having a lumen, a pair of spaced outwardly directed connecting portions defining ports of uniform diameter communicating through apertures with the lumen of the tubular member, said connecting portions having annular sections at an outer end thereof detachably received in the openings of a pair of adapters communicating with a set of adjoining chambers, and each of said tubular members being attached to one of said conduits to establish communication between the conduits through the connecting members and adapters to separate sets of adjoining chambers; and a plurality of removable, replaceable restriction members received in the ports of the upper portions of each connecting member, each of said restriction members comprising a cylindrical section having an outer diameter approximately equal to the inner diameter of the connecting portion port and an end wall with an orifice extending therethrough, with the orifices of at least some of the restriction members differing in diameter from the orifices of the remaining restriction members to develop a compressive pressure gradient against a patient's limb by the sleeve which progressively decreases from a lower to an upper limb portion, said restriction members being removable and replaceable so that the profile of said compressive pressure gradient may be changed.

* * * * *

UNITED STATES PATENT AND TRADEMARK OFFICE

CERTIFICATE OF CORRECTION

PATENT NO. : 4,320,746

DATED : March 23, 1982

INVENTOR(S) : EDWARD J. ARKANS and FRANK K. VILLARI

It is certified that error appears in the above—identified patent and that said Letters Patent is hereby corrected as shown below:

Column 6, line 2, delete "36" and insert therefor -- 96 --.

Column 6, line 61, delete "92a" and insert therefor -- 82a --.

Signed and Sealed this

First Day of June 1982

[SEAL]

*Attest:*

GERALD J. MOSSINGHOFF

*Attesting Officer*

*Commissioner of Patents and Trademarks*